US008919686B2

(12) United States Patent
Tenpaku et al.

(10) Patent No.: US 8,919,686 B2
(45) **Date of Patent: *Dec. 30, 2014**

(54) ROLL MEDIUM FEEDING DEVICE AND RECORDING APPARATUS

(75) Inventors: Hisashi Tenpaku, Nirasaki (JP); Seijun Horie, Matsumoto (JP); Takuya Yasue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 170 days.

This patent is subject to a terminal disclaimer.

(21) Appl. No.: 13/565,894

(22) Filed: Aug. 3, 2012

(65) Prior Publication Data

US 2013/0043340 A1 Feb. 21, 2013

(30) Foreign Application Priority Data

Aug. 17, 2011 (JP) ..... 2011-178397

(51) Int. Cl.
*B65H 19/22* (2006.01)
*B65H 19/12* (2006.01)

(52) U.S. Cl.
CPC ..... *B65H 19/126* (2013.01); *B65H 2405/40* (2013.01); *B65H 2801/36* (2013.01)
USPC ..... 242/533; 242/559.4

(58) Field of Classification Search
USPC ..... 242/533, 588, 559, 559.3, 559.4, 561, 242/557
See application file for complete search history.

(56) References Cited

U.S. PATENT DOCUMENTS

| | | | |
|---|---|---|---|
| 3,325,120 | A | 6/1967 | Brinkman |
| 4,154,470 | A | 5/1979 | Dalglish |
| 4,824,313 | A | 4/1989 | Miller |
| 5,253,972 | A | 10/1993 | Drew et al. |
| 5,524,415 | A | 6/1996 | Pachinger et al. |
| 6,299,100 | B1 | 10/2001 | Cloud |
| 7,360,740 | B2 | 4/2008 | Reagan et al. |
| 2003/0018233 | A1 | 1/2003 | Miller |
| 2004/0011914 | A1 | 1/2004 | Gandini |
| 2009/0104007 | A1 | 4/2009 | Umezawa |
| 2009/0242603 | A1 | 10/2009 | Kobayashi et al. |
| 2012/0091250 | A1 | 4/2012 | Tenpaku et al. |
| 2012/0187233 | A1 | 7/2012 | Tenpaku et al. |
| 2013/0043340 | A1 | 2/2013 | Tenpaku et al. |

FOREIGN PATENT DOCUMENTS

| | | |
|---|---|---|
| CN | 101412490 | 4/2009 |
| GB | 2175572 | 12/1986 |
| JP | 6-340357 | 12/1994 |
| JP | 2004-509036 | 3/2004 |

(Continued)

OTHER PUBLICATIONS

U.S. Appl. No. 13/252,607, Jul. 24, 2013, Office Action.
U.S. Appl. No. 13/347,826, Sep. 9, 2013, Office Action.

(Continued)

*Primary Examiner* — Sang Kim
(74) *Attorney, Agent, or Firm* — Workman Nydegger

(57) ABSTRACT

A roll medium feeding device includes a temporal placement portion on which a roll medium is placed temporarily, a roll holder that has a fitting portion which is movable in a width direction of the roll medium, and an elevating unit that lifts the roll medium. The elevating unit includes an elevating portion that has a placement portion and is capable of going up and down in an up-down direction, an operation lever that moves rotationally about a fulcrum, and moves the elevating portion with the rotational movement, and a pedal that is provided at a free end side of the operation lever.

4 Claims, 11 Drawing Sheets

(56) References Cited

FOREIGN PATENT DOCUMENTS

| | | |
|---|---|---|
| JP | 2006-229469 | 8/2006 |
| JP | 2009-023171 | 2/2009 |
| JP | 2009-234668 | 10/2009 |

OTHER PUBLICATIONS

U.S. Appl. No. 13/252,607, Nov. 12, 2013, Final Office Action.
U.S. Appl. No. 13/347,826, Aug. 15, 2012, Final Office Action.
U.S. Appl. No. 13/347,826, Jun. 9, 2014, Notice of Allowance.
U.S. Appl. No. 13/347,826, Jan. 8, 2014, Final Office Action.
U.S. Appl. No. 13/252,607, Mar. 28, 2014, Notice of Allowance.

ROLL MEDIUM FEEDING DEVICE AND RECORDING APPARATUS

BACKGROUND

1. Technical Field

The present invention relates to a roll medium feeding device having a fitting portion to be fitted into a core opening of a roll medium, and a recording apparatus including the roll medium feeding device.

In the present application, as types of the recording apparatus, an ink jet printer, a wire dot printer, a laser printer, a line printer, a copying machine, a facsimile machine, and the like are included.

2. Related Art

An existing printer has a feeding device which feeds out roll paper as described in JP-A-2009-23171. The feeding device has a shaft to be fitted into a core of the roll paper, and supports the roll paper with the shaft.

Further, in a recording apparatus such as a large-sized ink jet printer, roll paper is mounted on a roll paper holder mounted onto the recording apparatus after being once placed on a temporal placement table of the recording apparatus because the roll paper is heavy, as described in JP-A-2009-23171.

In the existing technique, a user places the roll paper on the temporal placement table, and then, lifts the roll paper to a height position of the shaft portion of a roll paper holder by approximately 2 to 5 cm with his (her) hands so as to position a core opening of a roll core and the shaft portion with each other. Thereafter, the user slides the roll paper holder horizontally in the shaft direction and fits the shaft portion into the core opening.

However, the weight of the roll paper is as heavy as 20 to 30 kg, further 40 kg, or up to 50 kg. As the roll paper is increased in weight, a lifting operation of the roll paper with man power being left to a user arises a serious problem in that the user is forced to do hard work.

SUMMARY

An advantage of some aspects of the invention is to provide a roll medium feeding device in which even a heavy roll medium is mounted on a roll paper holder without requiring a user to do hard work in response to the increase in weight of the roll medium, and a recording apparatus including the roll medium feeding device.

A roll medium feeding device according to a first aspect of the invention includes a temporal placement portion on which a roll medium is placed temporarily, a roll holder that has a fitting portion which is movable in a width direction of the roll medium and is fitted into a core opening of the roll medium, and holds the roll medium so as to be capable of feeding the roll medium, and an elevating unit that lifts the roll medium to a position at which the core opening of the roll medium is opposed to the fitting portion from a position of the roll medium which is placed on the temporal placement portion temporarily. In the roll medium feeding device, the elevating unit includes an elevating portion that has the placement portion and is capable of going up and down in an up-down direction, an operation lever that moves rotationally about a fulcrum, and moves the elevating portion with the rotational movement, and a pedal that is provided at a free end side of the operation lever.

According to the aspect of the invention, a user can operate the operation lever by pressing the pedal with his (her) foot. In this case, both hands of the user are free. Therefore, the user can mount the roll medium onto the roll holder easily in comparison with a configuration in which the pedal is not provided.

Further, the user can move the roll holder in the width direction with his (her) hand in a state where the roll medium is lifted so as to fit the fitting portion into the core opening of the roll medium reliably. At this time, the user moves the roll holder while putting one hand on the roll medium and moving the roll holder with the other hand. Then, the user applies a force in a direction of making them closer to each other so as to fit the fitting portion into the core opening reliably.

That is to say, with this configuration, the user can apply a force easily so as to fit the fitting portion into the core opening more reliably in comparison with a configuration in which the user moves the roll holder with one hand while operating the operation lever of the elevating unit with the other hand.

It is to be noted that the same holds true when the roll medium mounted onto the roll holder is detached and is placed down on the temporal placement portion in order to replace the roll medium with another type or size of the roll medium.

According to a second aspect of the invention, it is preferable that the elevating portion move to the upper side if the pedal is moved in a direction having at least a downward vector component in a vertical direction, in the first aspect of the invention.

According to the aspect of the invention, in addition to the action effects that are the same as those obtained in the first aspect of the invention, the user can lift the roll medium by pressing the pedal to the lower side with his (her) foot. With this configuration, the user can place his (her) own weight onto the pedal so as to lift the roll medium easily in comparison with a configuration in which the user moves the pedal to the upper side to lift the roll medium.

Furthermore, a lifting level of the roll medium can be adjusted by adjusting the weighing of the user's weight to be put onto the pedal. Therefore, an operation is easier in comparison with a configuration in which the user moves the pedal to the upper side to lift the roll medium. That is to say, the position of the roll medium in the up-down direction is easy to be adjusted to a position at which the fitting portion and the core opening are opposed to each other.

According to a third aspect of the invention, it is preferable that a cam portion that converts rotational movement of the operation lever in the up-down direction to up-down movement of the elevating portion and transmits a driving force thereto be provided on the operation lever at a position closer to the fulcrum, and a spot of the cam portion which abuts against the elevating portion be directed to a movement direction when the elevating portion moves to the upper side since the operation lever rotationally moves and the cam portion starts to move the elevating portion to the upper side until the operation lever stops and movement of the elevating portion to the upper side stops, in the first or second aspect of the invention.

As for the expression "spot of the cam portion which abuts against the elevating portion is directed to a movement direction when the elevating portion moves to the upper side," it means that a direction in which the abutting spot is directed may not be identical to the movement direction strictly. It may be sufficient that the spot is directed to substantially the movement direction, even with some error.

According to the aspect of the invention, in addition to the action effects that are the same as those obtained in the first or second aspect of the invention, a force in a normal line direction with respect to the abutting portion acts largely on the elevating portion from the cam portion. Therefore, a force in a direction of moving to the upper side acts largely on the elevating portion. On the other hand, a force in the lateral direction with respect to the up-down direction hardly acts on the elevating portion. Accordingly, a friction force between members other than the elevating portion and the cam portion on the elevating unit and the elevating portion can be eliminated substantially. As a result, transmission efficiency of a force when the elevating portion is made to go up becomes higher, thereby lifting the roll medium easily.

A recording apparatus according to a fourth aspect of the invention includes a feeding unit that is capable of feeding out a roll medium, and a recording unit that records onto the roll medium. In the recording apparatus, the feeding unit includes the roll medium feeding device according to any one of the first to third aspects of the invention.

According to the aspect of the invention, the feeding unit includes the roll medium feeding device according to any one of the first to third aspects of the invention. Accordingly, in the recording apparatus, the action effects that are the same as those obtained in any one of the first to third aspects of the invention can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

Figure 1:
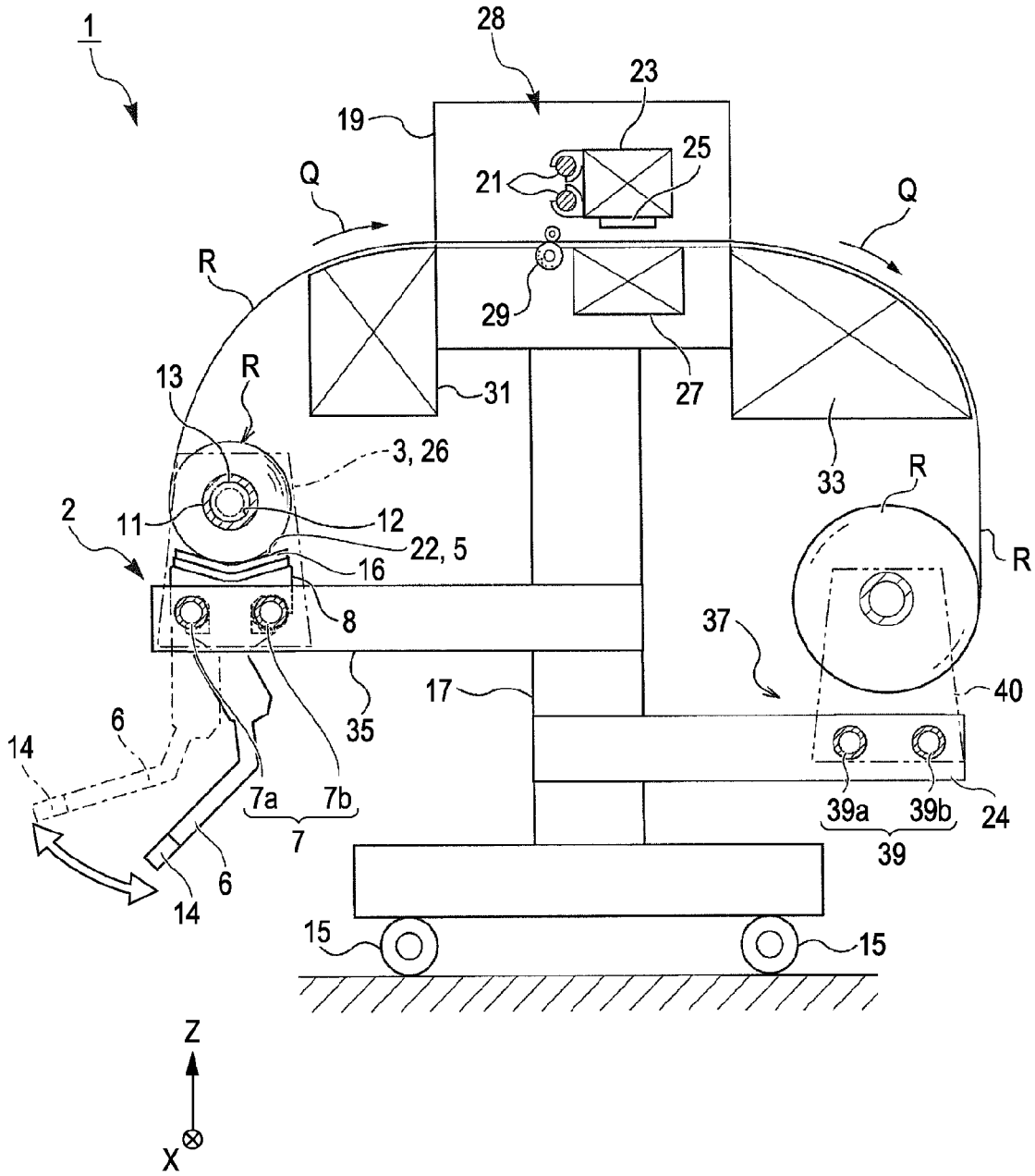
FIG. 1 is a cross-sectional side view illustrating a schematic entire configuration of a printer according to an embodiment.

FIG. 1 is a cross-sectional side view illustrating a schematic entire configuration of an ink jet printer 1 (hereinafter, simply referred to as printer) of a large size as a recording apparatus according to the embodiment.

As illustrated in FIG. 1, the printer 1 includes a medium feeding unit 26, a recording unit 28, and a roll-up unit 37. The medium feeding unit 26 can unroll a roll medium R wound in a roll form and feed out the roll medium R in a feeding direction Q. To be more specific, the medium feeding unit 26 has first holder portions 3 as a roll holder at a feeding side and a roller pair 29.

The first holder portions 3 can hold both ends of the roll medium R in a rotationally movable manner. The first holder portions 3 have fitting portions 13 to be fitted into core openings 12 of a roll core 11 of the roll medium R. The fitting portions 13 may have a configuration of being rotationally movable or a configuration of being driven with a driving force of a motor (not illustrated). When the fitting portions 13 have the configuration of being rotationally movable, the roll medium R is pulled and unrolled by the roller pair 29 which drives at the downstream side in the feeding direction.

On the other hand, when the fitting portions 13 are driven with the driving force of the motor, the medium feeding unit 26 may not have the roller pair 29.

It is to be noted that a pair of first holder portions 3 are arranged so as to be opposed to each other. At least one of the first holder portions 3 slides in the width direction X with respect to a guiding member 7 so that an mounting position thereof can be adjusted in accordance with the difference of a width dimension of the roll medium R.

Further, temporal placement tables 5 as a temporal placement portion and lifting units 2 as an elevating unit are provided at lower sides of the first holder portions 3. The temporal placement tables 5 are tables on which the roll medium R is placed temporarily before the roll medium R is mounted onto the first holder portions 3. As an example, the temporal placement tables 5 are constituted by placement portions 22 of elevating portions 16 (which will be described later) of the lifting units 2. It is needless to say that the temporal placement tables 5 may be configured separately from the lifting units 2. In addition, the lifting units 2 can lift the heavy roll medium R placed on the temporal placement tables 5 to the upper side easily so as to mount both ends of the roll medium R onto the first holder portions 3 easily.

To be more specific, each lifting unit 2 includes a base body portion 8, an operation lever 6, the elevating portion 16, and a pedal 14. The base body portion 8 can move in a sliding manner in the width direction X with respect to two of a first pipe members 7*a* and a second pipe member 7*b* as the guiding member 7. If a user presses the pedal 14 provided at a free end side of the operation lever 6 with his (her) foot to rotationally move the operation lever 6 in one direction, the elevating portion 16 goes up so as to lift the roll medium R. On the other hand, if the operation lever 6 is rotationally moved in the opposite direction, the elevating portion 16 goes down so as to lower the roll medium R. That is to say, the roll medium R that is relatively heavy can be lifted or lowered with a relatively small force using magnitude of a lever ratio of the operation lever 6.

Further, the recording unit 28 has a printer main body 19. A carriage guiding shaft 21 extending in the width direction X, a carriage 23, a recording head 25, and a medium supporting portion 27 are provided on the printer main body 19. The carriage 23 is provided so as to be movable in the width direction X while being guided by the carriage guiding shaft 21. The recording head 25 is provided on the carriage 23 at a position opposed to the medium supporting portion 27. The recording head 25 discharges ink onto the roll medium R so as to record. Further, the medium supporting portion 27 supports the roll medium R so as to set a distance between the roll medium R and the recording head 25 to a predetermined distance.

The roller pair 29 is provided inside the printer main body 19. However, the roller pair 29 may be provided at the outside of the printer main body 19 because it is sufficient that the roller pair 29 can feed the roll medium R in the feeding direction Q.

Further, a preheater 31 is provided at the upstream side with respect to the printer main body 19 in the feeding direction. The roll medium R is previously heated with the preheater 31 at a stage before recording is executed on the roll medium R. With this, ink landed on the roll medium R is easily dried when recording is executed.

In addition, an afterheater 33 is provided at the downstream side with respect to the printer main body 19 in the feeding direction. The afterheater 33 is provided in order to dry the ink landed on the roll medium R reliably before the roll medium R is wound by a roll-up unit 37 after recording has been executed.

Further, the roll-up unit 37 can roll up the roll medium R with a driving force of a motor (not illustrated). To be more specific, the roll-up unit 37 has second holder portions 40 as a roll holder at a roll-up side. The second holder portions 40 are mounted onto two of a third pipe member 39*a* and a fourth pipe member 39*b* as a guiding member 39. The roll-up unit 37 can hold the roll medium R which has been rolled up on the second holder portion 40.

It is to be noted that the printer 1 includes supporting frames 17 at both right and left ends so as to be opposed to each other. Each supporting frame 17 has casters 15 for movement at a lower end thereof and has an inverted T shape when seen from the side. The printer main body 19 is provided at the upper side of the supporting frames 17. Further, the guiding member 7 is attached to sub frames 35 attached to the supporting frames 17. In addition, both ends of the third pipe member 39*a* and the fourth pipe member 39*b* are held by holding portions 24 extending from the supporting frames 17.

Note that a Z-axis direction in the drawings corresponds to a vertical direction.

Figure 2:
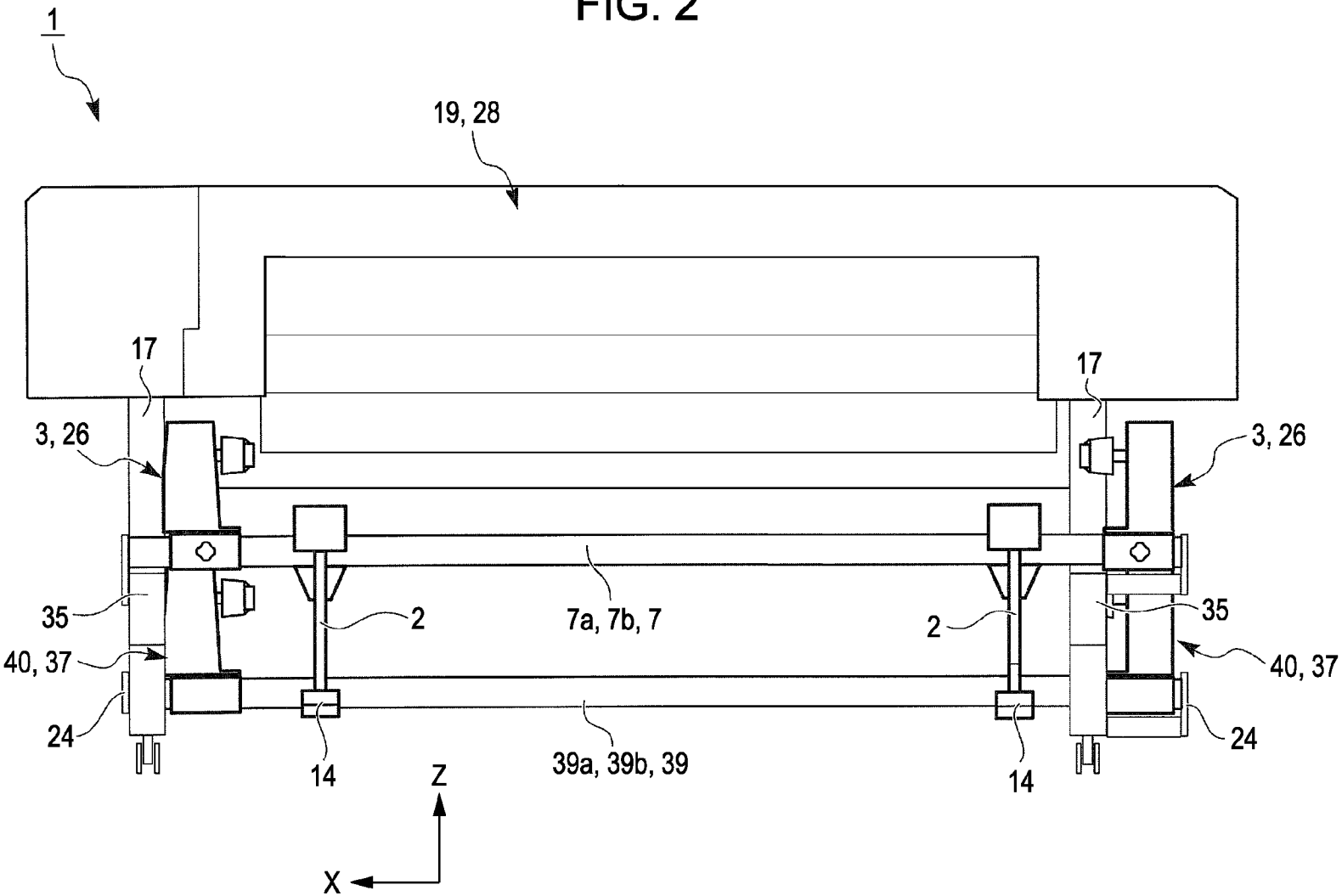
FIG. 2 is a front view illustrating the schematic entire configuration of the printer according to the embodiment.

FIG. 2 illustrates a front view illustrating a schematic entire configuration of the printer 1 according to the embodiment.

As illustrated in FIG. 2, the first holder portions 3 are provided at the front side with reference to the supporting frames 17 of the printer 1 and the second holder portions 40 are provided at the rear side with respect thereto. As described above, the first holder portions 3 are provided so as to slide with respect to the first pipe member 7*a* and the second pipe member 7*b* as the guiding member 7 of which both ends are held by the sub frames 35. In the same manner, the second holder portions 40 are provided so as to slide with respect to the third pipe member 39*a* and the fourth pipe member 39*b* as the guiding member 39 of which both ends are held by the holding portions 24.

A fixing manner of the second holder portions 40 to the third pipe member 39*a* and the fourth pipe member 39*b* is the same as a fixing manner of the first holder portions 3 to the first pipe member 7*a* and the second pipe member 7*b*. Hereinafter, a configuration in which the first holder portions 3 are fixed to the first pipe member 7*a* and the second pipe member 7*b* is described, and a configuration in which the second holder portions 40 are fixed to the third pipe member 39*a* and the fourth pipe member 39*b* is not described.

Figure 3:
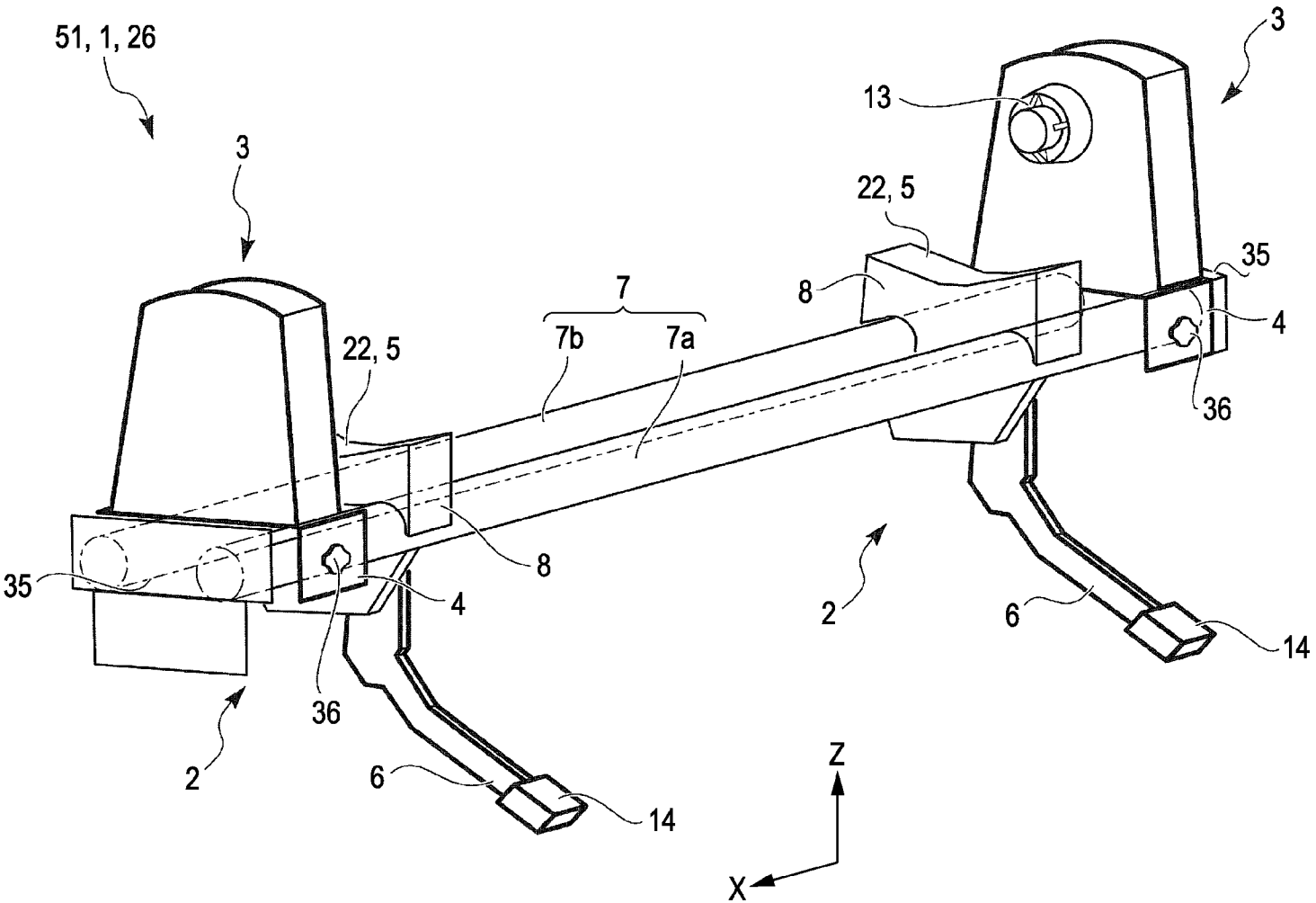
FIG. 3 is a perspective view illustrating a roll medium holder device of a medium feeding unit according to the embodiment.

FIG. 3 is a perspective view illustrating a roll medium holder device 51 on the medium feeding unit 26 according to the embodiment.

As illustrated in FIG. 3, the medium feeding unit 26 includes the roll medium holder device 51. The roll medium holder device 51 includes two of the first pipe member 7*a* and the second pipe member 7*b* as the guiding member 7 (guiding portion), the first holder portions 3 having the fitting portions 13, and the lifting units 2.

If knobs 36 with screws (not illustrated) are rotated in a direction of loosening the screws, the first holder portions 3 can be moved in a sliding manner with respect to the first pipe member 7*a* and the second pipe member 7*b*. To be more specific, base portions 4 provided on lower portions of the first holder portions 3 move in a sliding manner with respect to the first pipe member 7*a* and the second pipe member 7*b*. On the other hand, if the knobs 36 are rotated in a direction of fastening the screws, the first holder portions 3 can be fixed to the first pipe member 7*a* and the second pipe member 7*b*. Accordingly, positions of the pair of first holder portions 3 can be adjusted in accordance with the width size of the roll medium R.

It is to be noted that the lifting units 2 are provided so as to move in a sliding manner with respect to the first pipe member 7*a* and the second pipe member 7*b* between the pair of first holder portions 3. The lifting units 2 need not be configured so as to be switchable between a state of being movable in a sliding manner with respect to the first pipe member 7*a* and the second pipe member 7*b* and a state of being fixed thereto. It is sufficient that the lifting units 2 can be moved in a sliding manner to the lower side in the vicinity of side ends of the roll medium R in accordance with the size of the roll medium R so as to lift the side ends of the roll medium R.

Subsequently, an internal configuration of each lifting unit 2 is described.

Figure 4:
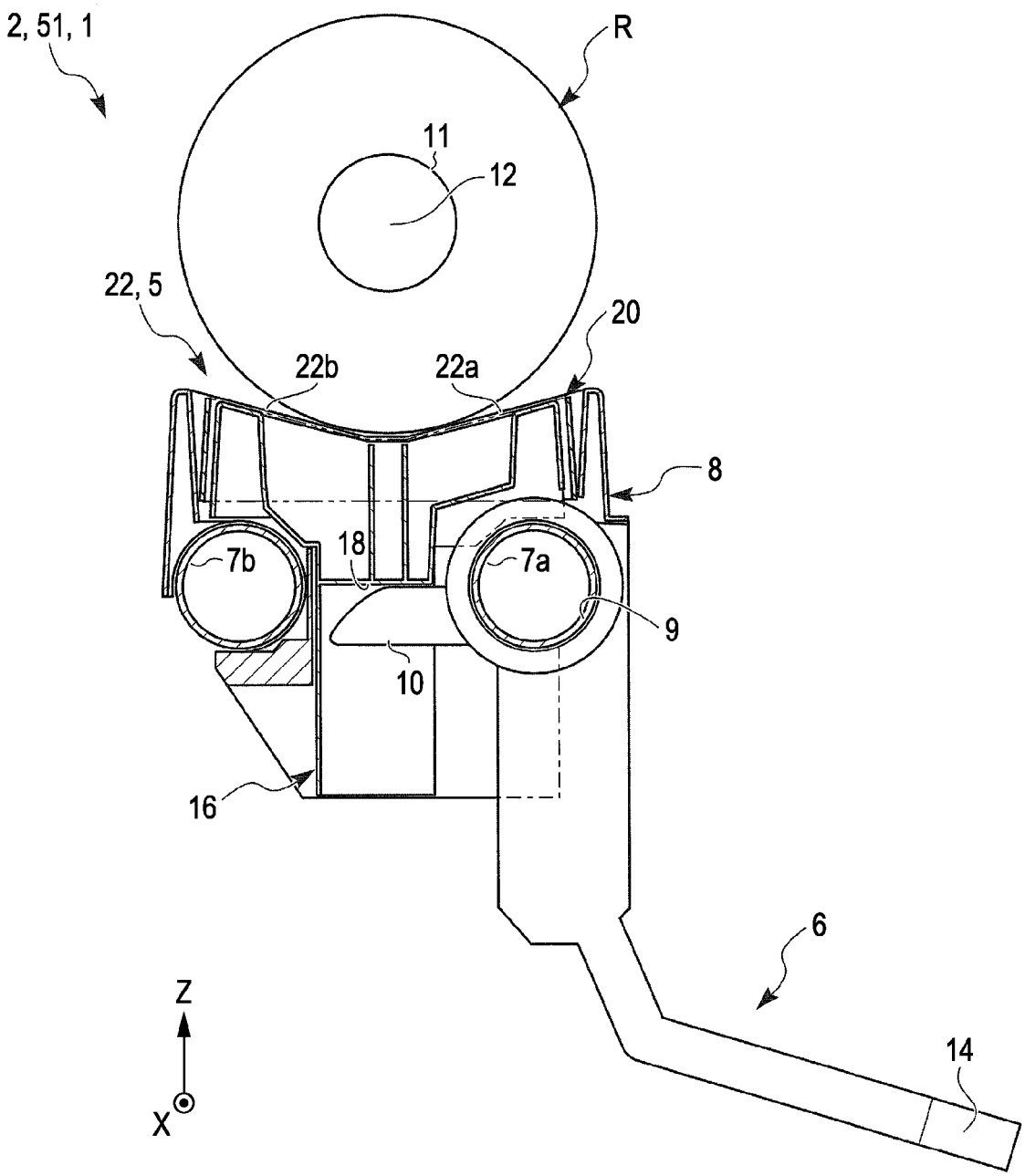
FIG. 4 is a cross-sectional side view illustrating an inner portion of a lifting unit according to the embodiment (before lifting).

FIG. 4 is a cross-sectional side view illustrating an inner portion of the lifting unit 2 according to the embodiment.

As illustrated in FIG. 4, each lifting unit 2 includes the operation lever 6, the base body portion 8, the elevating portion 16, and the pedal 14. Among them, a hole portion 9, a cam portion 10, and the pedal 14 are provided on the operation lever 6. The second pipe member 7*b* is inserted through the hole portion 9 and the operation lever 6 moves rotationally about the second pipe member 7*b*. Further, the first pipe member 7*a* and the second pipe member 7*b* are inserted through the base body portion 8. In addition, the elevating portion 16 is incorporated into the base body portion 8 and is guided by the base body portion 8 in the vertical direction Z.

The placement portion 22 on which the roll medium R is placed is provided at the upper side of the elevating portion 16, as the temporal placement table 5.

Further, a cam follower portion 18 is provided on a lower portion of the elevating portion 16. The cam follower portion 18 makes contact with the cam portion 10 of the operation lever 6. A cover member 20 is arranged between the vicinity of the placement portion 22 of the elevating portion 16 and the base body portion 8. The cover member 20 is provided so as to cover a space E between the elevating portion 16 and the base body portion 8 (see, FIG. 8) if the elevating portion 16 goes up.

Further, the placement portion 22 is formed such that both sides are higher than the center when seen from a shaft direction (X) of the first pipe member 7*a* and the second pipe member 7*b*. In other words, the upper surface of the placement portion 22 is formed such that two sides 22*a*, 22*b* at the upper side, which make contact with the roll medium R, are seen to form a V shape. With this, when the roll medium R is placed, the position of the roll medium R can be made stable such that the roll medium R does not roll over. As a technical viewpoint, the two sides 22*a*, 22*b* at the upper sides are not necessary to form such V shape. It is sufficient that a distance between the two sides 22*a*, 22*b* at the upper sides becomes shorter toward the lower side when seen from the shaft direction (X) and the two sides 22*a*, 22*b* make contact with an outer circumferential surface of the roll medium R.

Subsequently, an operation of fitting the fitting portions 13 into the core openings 12 of the roll medium R using the lifting units 2 is described.

Figure 5:
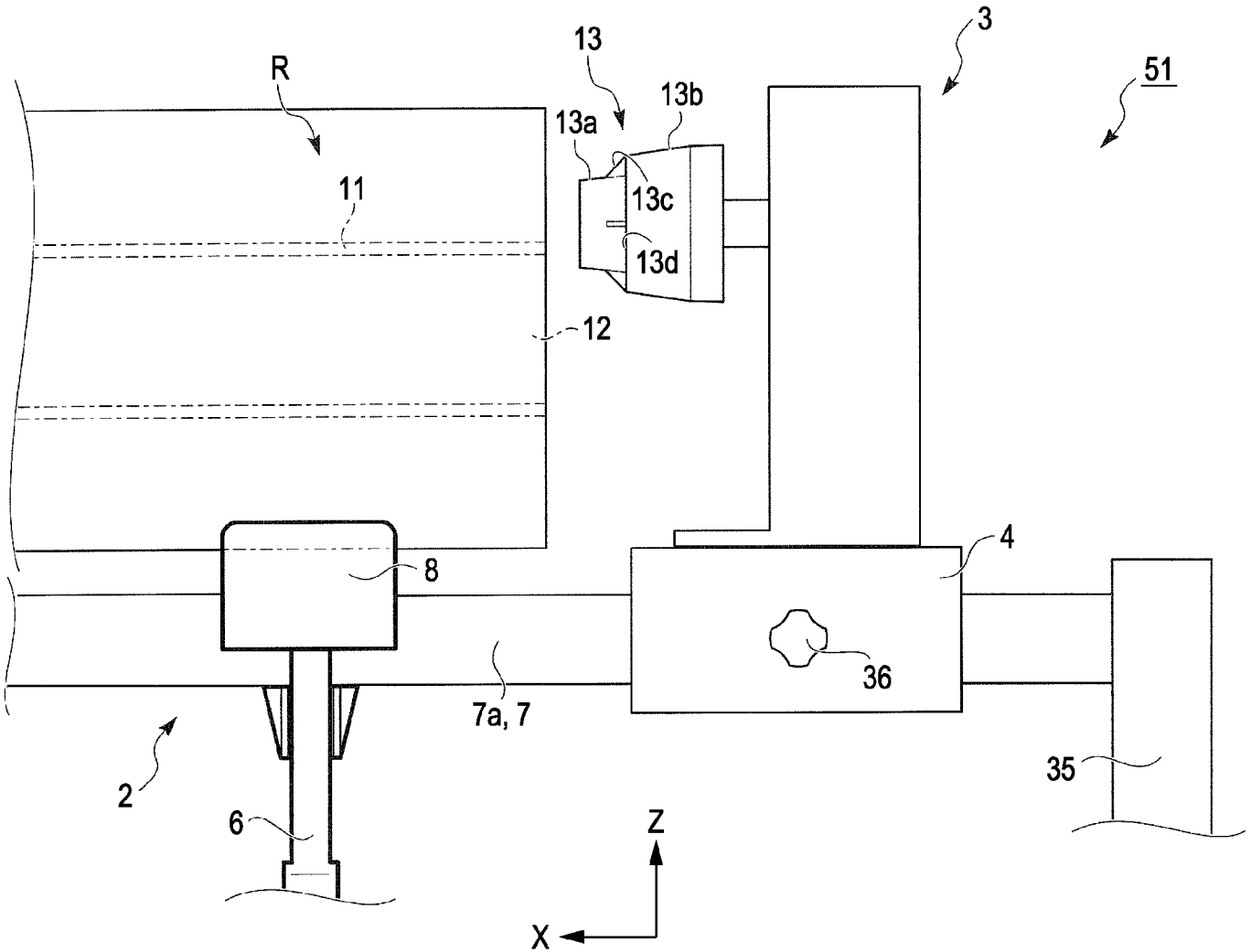
FIG. 5 is a front view illustrating the holder device before lifting a roll medium according to the embodiment.

FIG. 5 is a front view illustrating the roll medium holder device 51 before lifting the roll medium R according to the embodiment. FIG. 5 illustrates one first holder portion 3 of the pair of first holder portions 3. Since the other first holder portion (3) also has the same configuration, only one of them is described and the other one is not described.

Further, each fitting portion 13 in the embodiment includes a first supporting portion 13*a*, a second supporting portion 13*b*, an inclined portion 13*c*, and a step 13*d*. Among them, the first supporting portion 13*a* is fitted into the core opening (12) of the roll core (11) of the roll medium (R) having a first size and supports the roll medium (R) having the first size. On the other hand, the second supporting portion 13*b* is fitted into the core opening 12 of the roll core 11 of the roll medium R having a second size and supports the roll medium R having the second size. The roll medium R having the second size has the core opening larger than that having the first size.

The first supporting portion 13*a* and the second supporting portion 13*b* are slightly inclined with respect to the width direction X so as to be gradually narrower toward a front end side (roll medium R side) of the fitting portion 13. That is to say, the first supporting portion 13*a* and the second supporting portion 13*b* are slightly inclined like an outer circumferential surface of a circular cone.

Further, the step 13*d* is formed between the first supporting portion 13*a* and the second supporting portion 13*b*. The inclined portion 13*c* is formed so as to connect the first supporting portion 13*a* and the second supporting portion 13*b*. The step 13*d* and the inclined portion 13*c* are formed in order to fit the second supporting portion 13*b* of the fitting portion 13 into the core opening 12 of the roll core 11 of the roll medium R having the second size smoothly.

It is to be noted that in the embodiment, the roll member R having the second size is employed for description.

Figure 6:
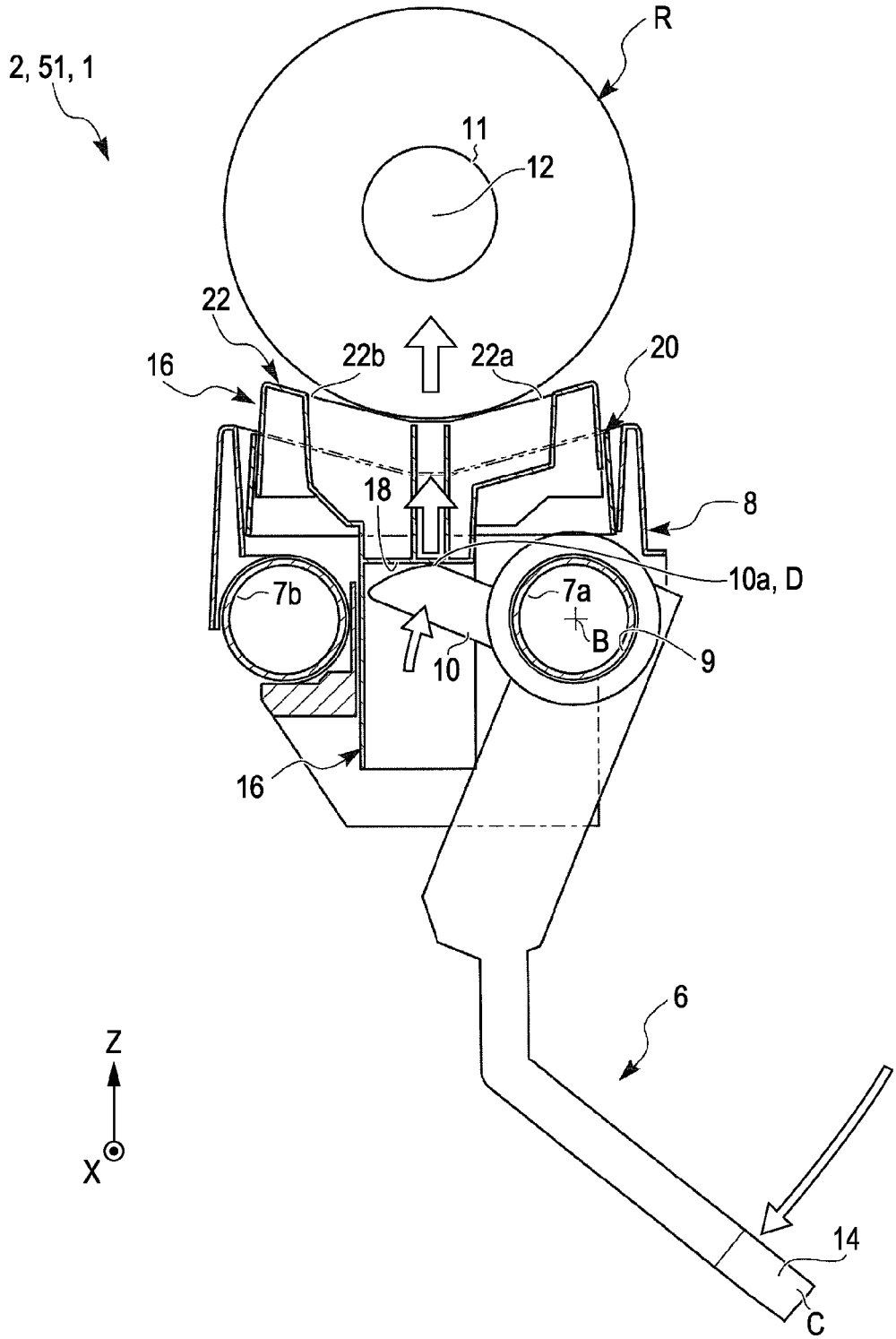
FIG. 6 is a cross-sectional side view illustrating the inner portion of the lifting unit according to the embodiment (during lifting).

FIG. 6 is a cross-sectional side view illustrating an operation of the lifting unit 2 during lifting according to the embodiment.

As illustrated in FIG. 6, the operation lever 6 is moved rotationally about the first pipe member 7*a* in the clockwise direction in FIG. 6 from the state of FIG. 4. To be more specific, a user presses the pedal 14 with his (her) foot so as to rotationally move the operation lever 6. In this case, a distance from a fulcrum B as the center of the rotational movement of the operation lever 6 to a point of effort C (point to which force if applied) at which a force is applied to the operation lever 6 is made to be sufficiently longer than a distance from the center of the rotational movement (fulcrum B) of the operation lever 6 to a point of action D as a spot 10*a* of the cam portion 10, which abuts against the cam follower portion 18, based on the principle of leverage.

The cam portion 10 rotationally moves with the rotational movement of the operation lever 6. Then, the cam portion 10 applies a force of pressing up the cam follower portion 18 of the elevating portion 16 to the upper side. This moves the elevating portion 16 to the upper side. Further, the elevating portion 16 moves the roll medium R to the upper side. In this case, the lifting unit 2 converts a relatively small force of the user to a large force with the principle of leverage so as to lift the heavy roll medium R to the upper side.

Further, the spot 10*a* at which the cam portion 10 abuts against the cam follower portion 18 is directed to the movement direction Z of the elevating portion 16. Accordingly, the direction of the force of the cam portion 10, which acts on the cam follower portion 18, is the movement direction Z of the elevating portion 16. In other words, a force in the lateral direction with respect to the movement direction Z of the elevating portion 16 does not act. Therefore, a frictional resistance between the elevating portion 16 and the base body portion 8 can be made as small as possible. As a result, the loss of force can be made minimum so that the roll member R can be lifted easily.

It is to be noted that the cam follower portion 18 moves linearly while the cam portion 10 rotationally moves. Therefore, friction is generated between the cam portion 10 and the cam follower portion 18. However, the spot 10*a* is formed to be smooth so as to reduce the influence of friction.

Figure 7:
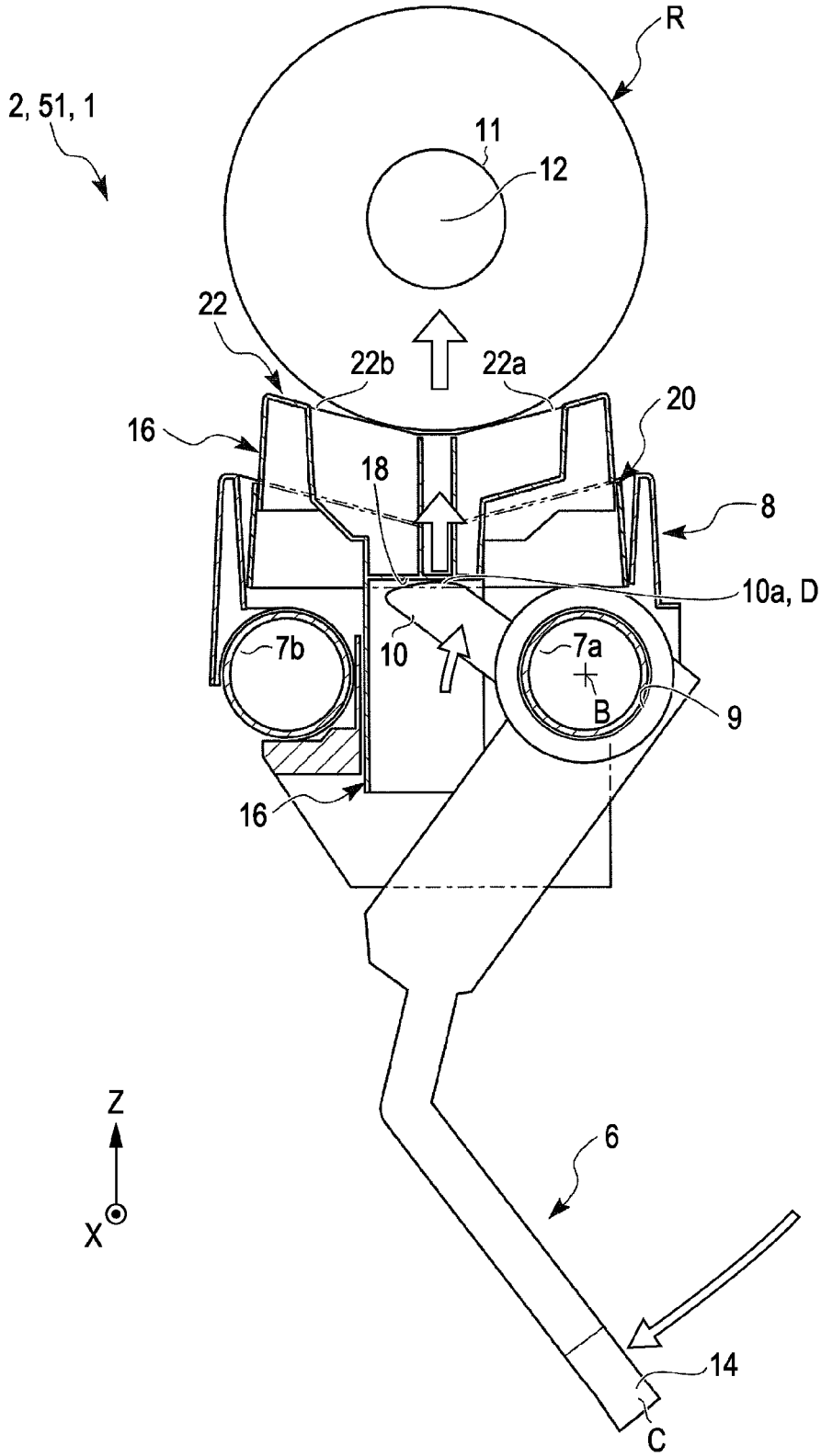
FIG. 7 is a cross-sectional side view illustrating the inner portion of the lifting unit according to the embodiment (during lifting).

FIG. 7 is a cross-sectional side view illustrating an operation of the lifting unit 2 during lifting according to the embodiment.

As illustrated in FIG. 7, the operation lever 6 is further moved rotationally in the clockwise direction in FIG. 7 from the state of FIG. 6. Then, the cam portion 10 is further moved rotationally. This moves the elevating portion 16 to the upper side further. Then, the elevating portion 16 moves the roll medium R to the upper side further. In this case, the cover member 20 attached between the elevating portion 16 and the base body portion 8 abuts against the elevating portion 16. In the embodiment, an outer side surface of the elevating portion 16 and an inner side surface of the cover member 20 abut against each other.

It is to be noted that a configuration in which a projection or the like is provided so as to make the cover member 20 and the elevating portion 16 abut against each other may be employed.

In this case, the spot 10*a* at which the cam portion 10 abuts against the cam follower portion 18 also is directed to the movement direction Z of the elevating portion 16. Accordingly, a force in the lateral direction with respect to the movement direction Z of the elevating portion 16 does not act.

Figure 8:
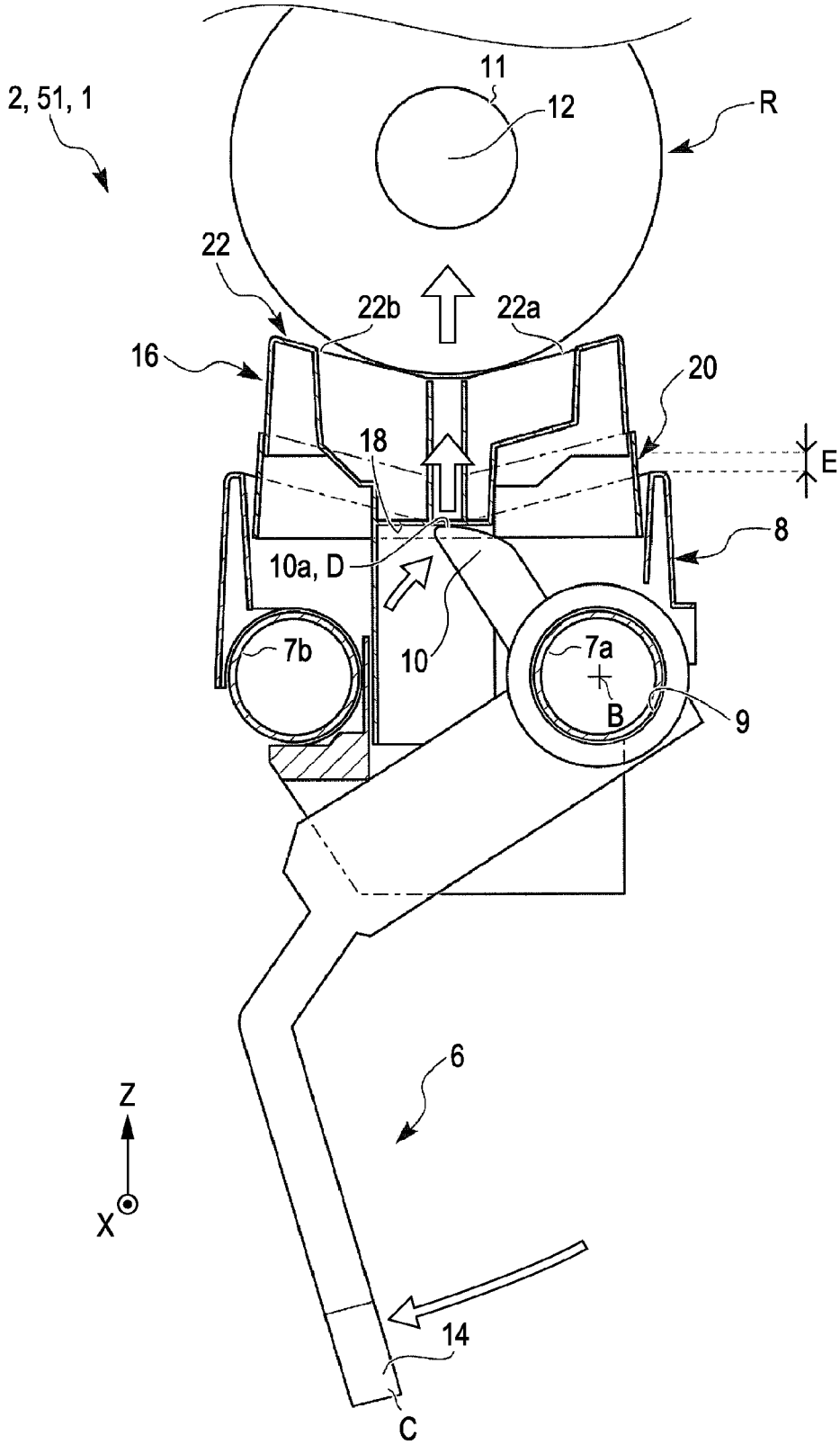
FIG. 8 is a cross-sectional side view illustrating the inner portion of the lifting unit according to the embodiment (after lifting).
Figure 9:
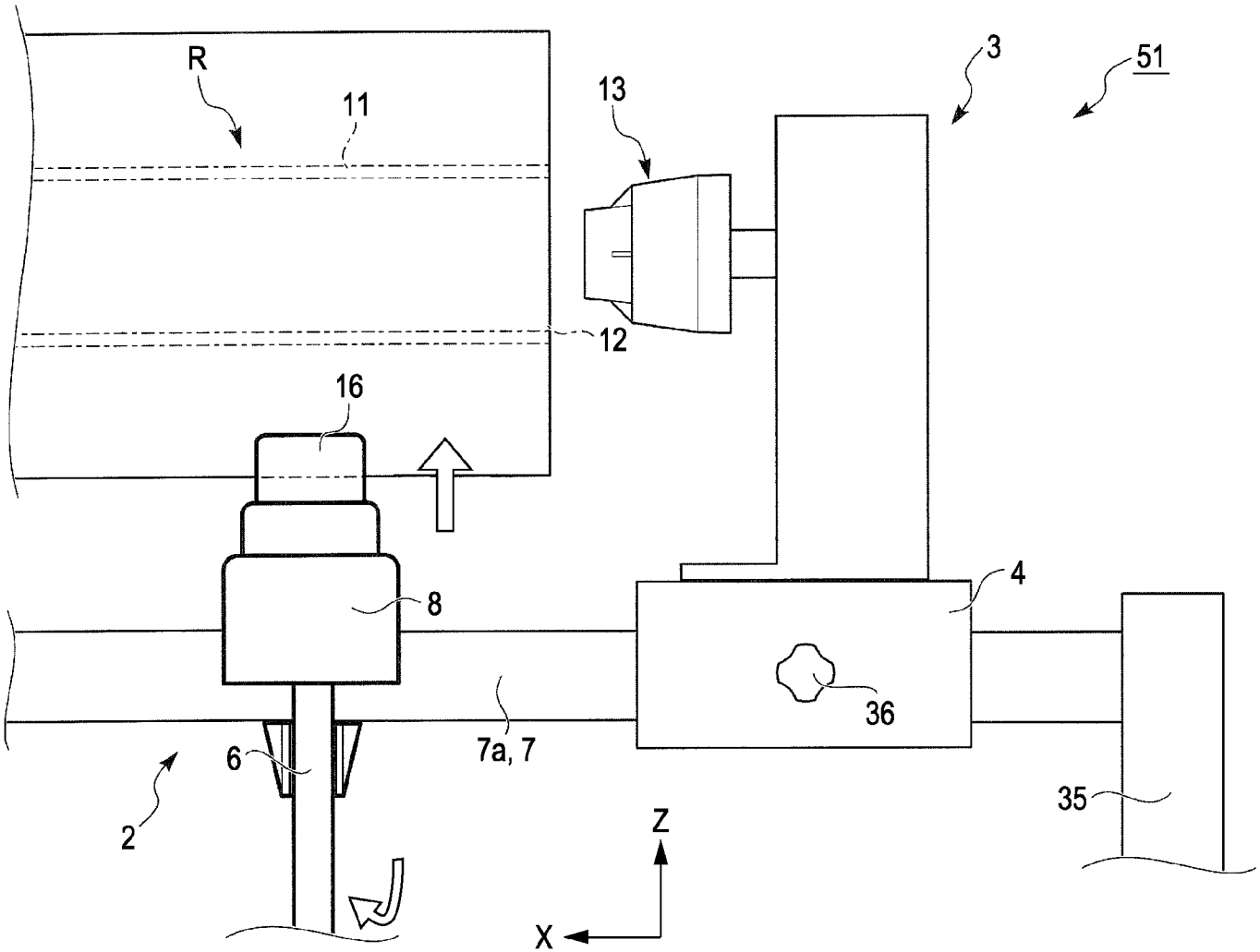
FIG. 9 is a front view illustrating the holder device when lifting the roll medium according to the embodiment.

FIG. 8 is a cross-sectional side view illustrating the lifting unit 2 after lifting. Further, FIG. 9 is a front view of a state of FIG. 8.

As illustrated in FIG. 8, the operation lever 6 is further moved rotationally in the clockwise direction in FIG. 8 from the state of FIG. 7. With this, the cam portion 10 is moved rotationally further. This moves the elevating portion 16 to the upper side further. Then, the elevating portion 16 moves the roll medium R to the upper side further. In this case, the spot 10*a* at which the cam portion 10 abuts against the cam follower portion 18 is also directed to the movement direction Z of the elevating portion 16. Accordingly, a force in the lateral direction with respect to the movement direction Z of the elevating portion 16 does not act.

At this time, the cover member 20 moves to the upper side together with the elevating portion 16. Then, the cover member 20 covers a space E between the elevating portion 16 and the base body portion 8, this space E is generated when the elevating portion 16 moves to the upper side. Accordingly, there arises no risk that foreign object enters the space E. In addition, there is also no risk that an accident that a user's hand is caught in the space E by mistake occurs. In particular, since the space E is generated when a moving distance of the elevating portion 16 is relatively long, the configuration having the cover member 20 is effective.

Further, there arises a risk that an accident occurs when the roll medium R is heavy. Therefore, the configuration having the cover member 20 is effective.

Further, as illustrated in FIG. 9, when the core opening 12 of the roll core 11 of the roll medium R has been moved to the height of the fitting portion 13 of the first holder portion 3, the rotational movement of the operation lever 6 is made to stop so as to stop lifting of the roll medium R.

Figure 10:
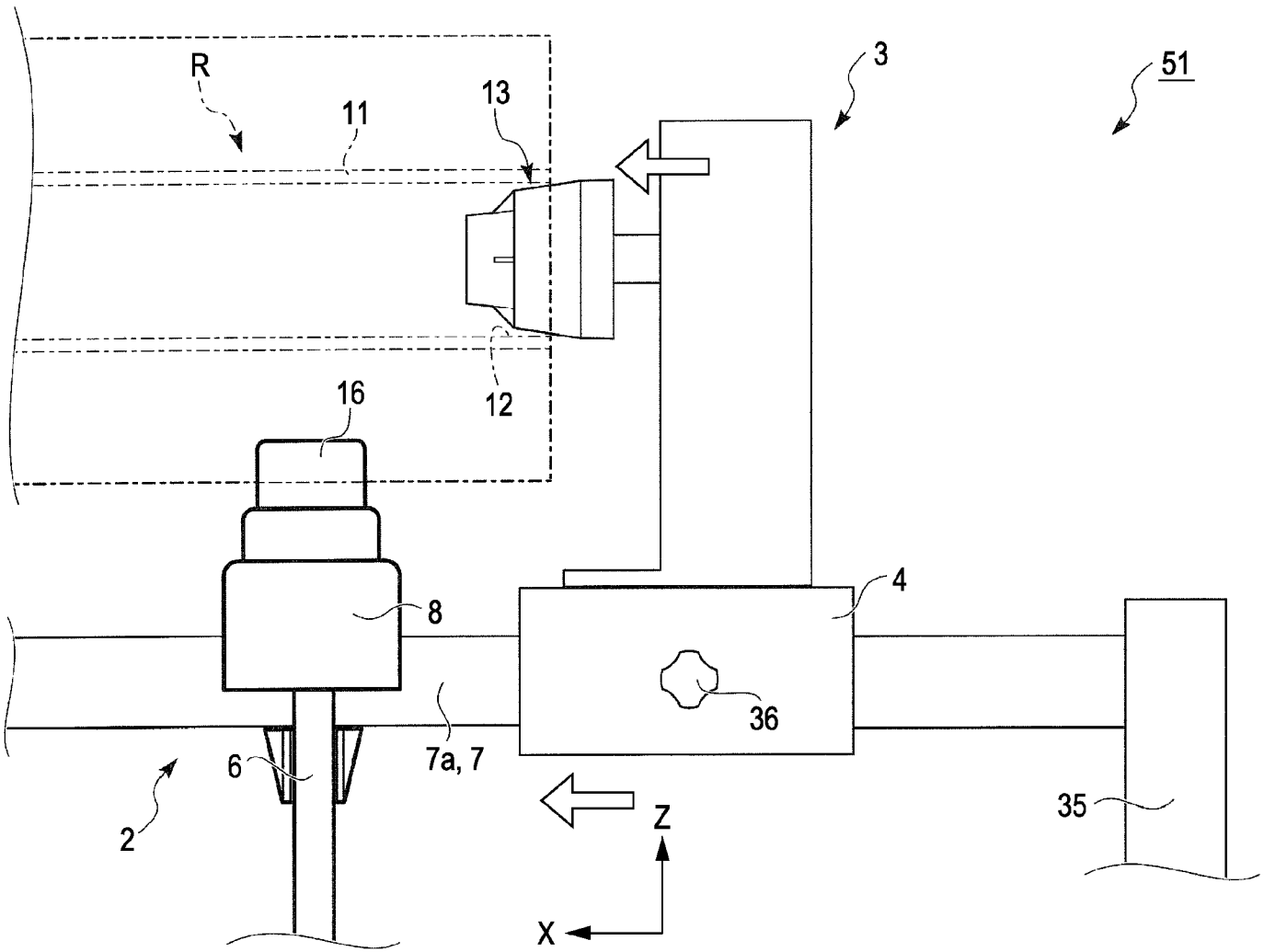
FIG. 10 is a front view illustrating a state where a first holder portion is made to move in a sliding manner according to the embodiment.

FIG. 10 is a front view illustrating a state where the first holder portion 3 has been moved in a sliding manner according to the embodiment.

Figure 11:
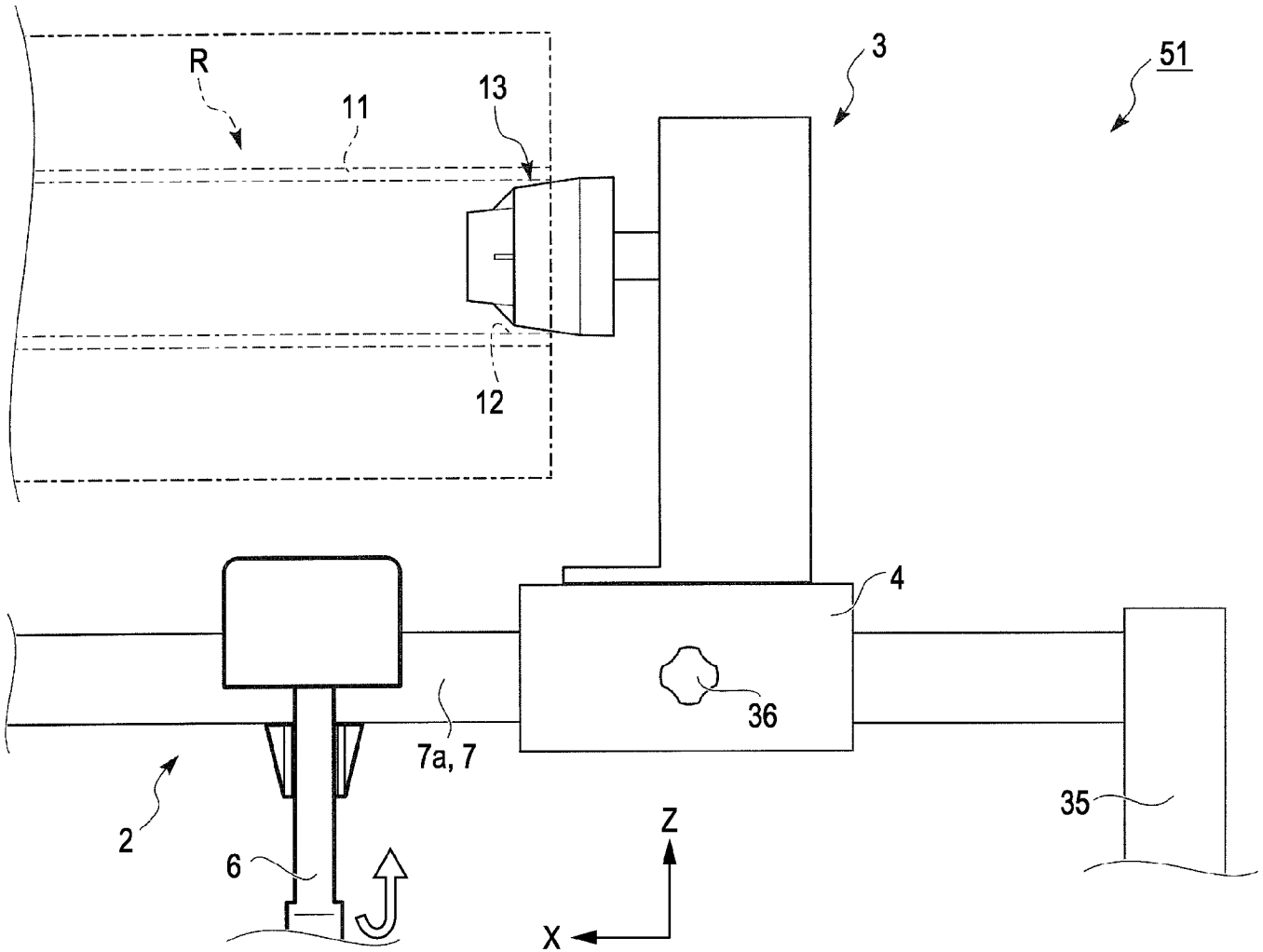
FIG. 11 is a front view illustrating a state where the roll medium has been mounted onto the first holder portion according to the embodiment.

Further, FIG. 11 is a front view illustrating a state where the roll member R has been mounted onto the first holder portion 3.

It is to be noted that FIG. 10 and FIG. 11 illustrate one first holder portion 3 of the pair of first holder portions 3.

As illustrated in FIG. 10, the height of the fitting portion 13 of the first holder portion 3 at the one end side and the height of the core opening 12 of the roll core 11 of the roll medium R at the one end side are made to be the same, and then, the first holder portion 3 at the one end side is moved to the side of the roll medium R in a sliding manner. Thereafter, the fitting portion 13 of the one first holder portion 3 is fitted into the core opening 12 of the roll core 11.

Further, a user presses the first holder portion 3 to the side of the roll medium R with a certain level of force. With this, the second supporting portion 13*b* of the fitting portion 13 is fitted into the core opening 12 of the roll core 11 of the roll medium R tightly.

Then, the knob 36 is rotated as described above so as to fix the one first holder portion 3 to the first pipe member 7*a* and the second pipe member 7*b*.

Thereafter, as illustrated in FIG. 11, the user gets his (her) foot off the pedal 14 of the operation lever 6 of the lifting unit 2 so as to return the operation lever 6 to an original posture (see, FIG. 4) and lower the elevating portion 16.

It is needless to say that the fitting portions 13 of the pair of first holder portions 3 may be fitted into the core openings 12 of the roll medium R at both sides at the substantially same timing by two persons in corporation. Alternatively, one person may fit the fitting portion 13 at one side into the core opening 12 at a time.

As described above, each lifting unit 2 according to the embodiment has the pedal 14. Therefore, a user can operate the operation lever 6 by pressing the pedal 14 with his (her) foot. In this case, both hands of the user are free. Therefore, the user can mount the roll medium R easily in comparison with a configuration in which the pedal 14 is not provided. In addition, the user can place his (her) own weight onto the pedal 14 so as to apply a force to the operation lever 6 easily in comparison with a configuration in which the user operates with his (her) hands. That is to say, the user can lift the roll medium R easily.

Further, the user moves each first holder portion 3 to the side of the roll medium R with his (her) hands in a state where the roll medium R is lifted so as to fit the fitting portion 13 into the core opening 12 of the roll medium R reliably. In this case, the user moves each first holder portion 3 while putting one hand on the roll medium R and moving the first holder portion 3 with the other hand. Then, a user applies a force in a direction of making them closer to each other so as to fit each fitting portion 13 into the core opening 12 reliably.

That is to say, with this configuration, the user can apply a force easily so as to fit each fitting portion 13 into the core opening 12 more reliably in comparison with a configuration in which the user moves each first holder portion 3 with one hand while operating the operation lever 6 of each lifting unit 2 with the other hand.

It is to be noted that when the roll medium R is detached from the first holder portions 3, the user moves each first holder portion 3 to the outer side in the width direction in a sliding manner and pulls the fitting portion 13 from the core opening 12 of the roll core 11. In this case, if the user pulls the fitting portion 13 while supporting the roll medium R by the lifting unit 2, a friction force between the fitting portion 13 and the roll core 11 can be reduced, thereby easily pulling it out.

In addition, it is preferable that the elevating portions 16 be moved to the upper side if the pedals are moved in a direction having at least a downward vector component in the vertical direction. With this configuration, the user can place his (her) own weight onto each pedal 14 so as to lift the roll medium R easily. As a technical viewpoint, it is sufficient that each operation lever 6 is moved rotationally by operating the pedal 14 with foot of the user so as to lift the roll medium R. Accordingly, the movement direction of the pedals 14 when lifting the roll medium R may not be a direction having a downward vector component in the vertical direction.

Moreover, in the embodiment, the operation levers 6 having the pedals 14 are moved rotationally so that the cam portions 10 move the elevating portions 16 to the upper side. However, the invention is not limited thereto. As a mechanism of transmitting a driving force, a link mechanism or a rack and pinion mechanism may be employed. That is to say, a unit for transmitting a driving force is not limited to the cam mechanism. Further, in the embodiment, the elevating portions 16 move linearly. However, the elevating portions 16 may not move linearly and may move so as to draw an arc, for example.

Further, the pedals 14 in the embodiment are formed integrally with the free ends of the operation levers 6. However, the pedals 14 may not be integrated with the operation levers 6. Alternatively, the pedals 14 may be configured to be movable rotationally with respect to the operation levers 6 in order to make operations easy.

In the embodiment, the lifting units 2 as an elevating unit are provided at the lower sides of the first holder portions 3 as the medium feeding unit 26. However, the lifting units 2 as the elevating unit may be provided at the lower sides of the second holder portions 40 as the roll-up unit 37. In such a case, the roll medium R can be detached from the second holder portions 40 and be placed on a predetermined place gently. Since the roll medium R which has been rolled up is heavy, a configuration in which the lifting units 2 are provided at the lower sides of the second holder portions 40 is effective.

The medium feeding unit 26 as a roll medium feeding device according to the embodiment includes the temporal placement tables 5 as the temporal placement portion on which the roll medium R is placed temporarily, the first holder portions 3 as the roll holder that have the fitting portions 13 which are movable in the width direction X of the roll medium R and are fitted into the core openings 12 of the roll medium R, and hold the roll medium R so as to feed the roll medium R, and the lifting units 2 as the elevating unit that lift the roll paper R to a position at which the core openings 12 of the roll medium R are opposed to the fitting portions 13 from a position of the roll medium R which is placed on the temporal placement portions 5 temporarily. The lifting units 2 have the elevating portions 16 that have the placement portions 22 and are capable of going up and down in the up-down direction, the operation levers 6 that move rotationally about the fulcrums B, and move the elevating portions 16 with the rotational movement, and the pedals 14 that are provided at the free end sides of the operation levers 6.

Further, in the embodiment, the elevating portions 16 move to the upper side if the pedals 14 are moved in a direction having at least a downward vector component in a vertical direction.

Further, in the embodiment, the cam portions 10 which convert rotational movement of the operation levers 6 in the up-down direction to up-down movement of the elevating portions 16 and transmit driving forces are provided at positions closer to the fulcrums B of the operation levers 6, and spots 10*a* of the cam portions 10 which abut against the elevating portions 16 are directed to the movement direction when the elevating portions 16 move to the upper side since the operation levers 6 rotationally move and the cam portions 10 start to move the elevating portions 16 to the upper side until the operation levers 6 stop and movement of the elevating portions 16 to the upper side stops.

The printer 1 as a recording apparatus according to the embodiment includes a feeding unit which is capable of feeding out the roll medium R, and the recording unit 28 which records onto the roll medium R.

It is to be noted that the invention is not limited to the above-described embodiment and various variations can be made in the scope of the invention. It is needless to say that the variations are also encompassed in the scope of the invention.

What is claimed is:

1. A roll medium feeding device comprising:

a temporal placement portion on which a roll medium is placed temporarily;

a roll holder that has a fitting portion which is movable in a width direction of the roll medium and is fitted into a core opening of the roll medium, and holds the roll medium so as to feed the roll medium, and an elevating unit that lifts the roll medium to a position at which the core opening of the roll medium is opposed to the fitting portion from a position of the roll medium which is placed on the temporal placement portion temporarily, wherein the elevating unit includes:

an elevating portion that has a placement portion and is capable of going up and down in an up-down direction;

an operation lever that moves rotationally about a fulcrum, and moves the elevating portion with the rotational movement, and a pedal that is provided at a free end side of the operation lever, wherein a cam portion that converts rotational movement of the operation lever in the up-down direction to up-down movement of the elevating portion and transmits a driving force thereto is provided on the operation lever at a position closer to the fulcrum, and a spot of the cam portion which abuts against the elevating portion is directed to a movement direction when the elevating portion moves to the upper side since the operation lever rotationally moves and the cam portion starts to move the elevating portion to the upper side until the operation lever stops and movement of the elevating portion to the upper side stops.

2. The roll medium feeding device according to claim 1, wherein the elevating portion moves to the upper side if the pedal is moved in a direction having at least a downward vector component in a vertical direction.

3. A recording apparatus comprising:

a feeding unit that is capable of feeding out a roll medium, and a recording unit that records onto the roll medium, wherein the feeding unit includes the roll medium feeding device according to claim 2.

4. A recording apparatus comprising:

a feeding unit that is capable of feeding out a roll medium, and a recording unit that records onto the roll medium, wherein the feeding unit includes the roll medium feeding device according to claim 1.

* * * * *